US007404676B2

(12) United States Patent
Stübner

(10) Patent No.: US 7,404,676 B2
(45) Date of Patent: Jul. 29, 2008

(54) AXIAL LOCK FOR THE WHEEL BEARING OF POLE VEHICLES

(75) Inventor: Frank Stübner, Ernstroda (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 300 days.

(21) Appl. No.: 10/539,296

(22) PCT Filed: Dec. 16, 2003

(86) PCT No.: PCT/EP03/14287

§ 371 (c)(1),
(2), (4) Date: Mar. 31, 2006

(87) PCT Pub. No.: WO2004/058515

PCT Pub. Date: Jul. 15, 2004

(65) Prior Publication Data

US 2006/0188192 A1 Aug. 24, 2006

(30) Foreign Application Priority Data

Dec. 20, 2002 (DE) ..... 102 60 001

(51) Int. Cl.
*F16C 43/04* (2006.01)

(52) U.S. Cl. ..... 384/539; 384/903

(58) Field of Classification Search ..... 384/537, 384/539, 543–547, 561, 584, 585, 903; 180/252, 180/253, 65.1–65.8; 310/75 R
See application file for complete search history.

(56) References Cited

U.S. PATENT DOCUMENTS

| | | | | |
|---|---|---|---|---|
| 2,645,298 | A | 7/1953 | Hawkins et al. | |
| 3,163,250 | A * | 12/1964 | Gibson | 180/65.5 |
| 3,690,398 | A | 9/1972 | Hause | |
| 5,746,517 | A * | 5/1998 | Durham et al. | 384/538 |
| 5,853,250 | A | 12/1998 | Krude et al. | |
| 6,367,571 | B1 * | 4/2002 | Schwarz | 180/65.5 |
| 6,661,137 | B2 * | 12/2003 | Gauthier | 310/75 R |

FOREIGN PATENT DOCUMENTS

| | | | |
|---|---|---|---|
| DE | 2357451 | A * | 5/1975 |
| DE | 42 27 954 | A1 | 2/1994 |
| GB | 1 559 276 | | 1/1980 |

* cited by examiner

*Primary Examiner*—Thomas R Hannon
(74) *Attorney, Agent, or Firm*—Davis Bujold & Daniels, P.L.L.C.

(57) ABSTRACT

An axial securing system for the wheel bearing of a pole-guided vehicle is described, in which the wheel bearing is positioned in line with the pole pivot point (1) and centrally with respect to the wheel area, the system comprising at least two clip-rings (3) seated in grooves (7), and the parts of the housing (4, 5) that form a gap (6) over the clip-rings (3) are extended in the direction of the clip-rings (3) so that the gap (6) above the clip-rings (3) is smaller than the grooves (7) in which the clip-rings (3) are seated.

1 Claim, 1 Drawing Sheet

AXIAL LOCK FOR THE WHEEL BEARING OF POLE VEHICLES

This application is a national stage completion of PCT/EP2003/014287 filed Dec. 16, 2003 which claims priority from German Application Ser. No. 102 60 001.5 filed Dec. 20, 2002.

FIELD OF THE INVENTION

The present invention concerns a securing system for the wheel bearing of pole-guided vehicles.

BACKGROUND OF THE INVENTION

Pole-guided vehicles, in particular floor trolleys, have a pole and a drive wheel that can be steered by way of the pole. Usually the pole and the drive wheel are positioned a distance away from the longitudinal mid-plane of the vehicle in the lateral direction.

In the prior art, owing to restricted structural space, the known bearings of the wheel hub drives usually used are seldom positioned directly in line with the pivot of the pole and centrally with respect to the area of the running wheel, whereas this location is found optimal. In such a case, again owing to the restricted structural space, it is very difficult to provide optimum axial securing of the wheel. The securing rings marketed, which are provided with assembly and dismantling bores, are not appropriate for use in this application because of the restricted space.

The purpose of the present invention is to provide an axial securing system for the wheel bearing of a pole-guided vehicle, which effectively prevents the running wheel from coming off the wheel hub drive. According to the invention, besides functioning very reliably, the axial securing system, in particular, is intended to be of a simple structure that can be manufactured inexpensively.

SUMMARY OF THE INVENTION

According to this, it is proposed to position the bearing in line with the pole pivot point and centrally with respect to the running wheel area, and secure it axially by way of at least two retaining clip-rings. To prevent the clip-rings from slipping out of their grooves even if, under the action of forces that result, for example, due to transverse forces or impacts from outside, their spring force is overcome; parts of the housing are extended in the direction of the clip-rings.

This extension is formed in such manner that by simple machining the gap above the clip-rings is smaller than the grooves in which the clip-rings are seated. This ensures that the clip-rings are held fast in their grooves, even under extreme conditions, so ensuring the safety of the vehicle.

BRIEF DESCRIPTION OF THE DRAWING

The invention will now be described, by way of example, with reference to the accompanying drawings in which.

DETAILED DESCRIPTION OF THE INVENTION

Figure 1:
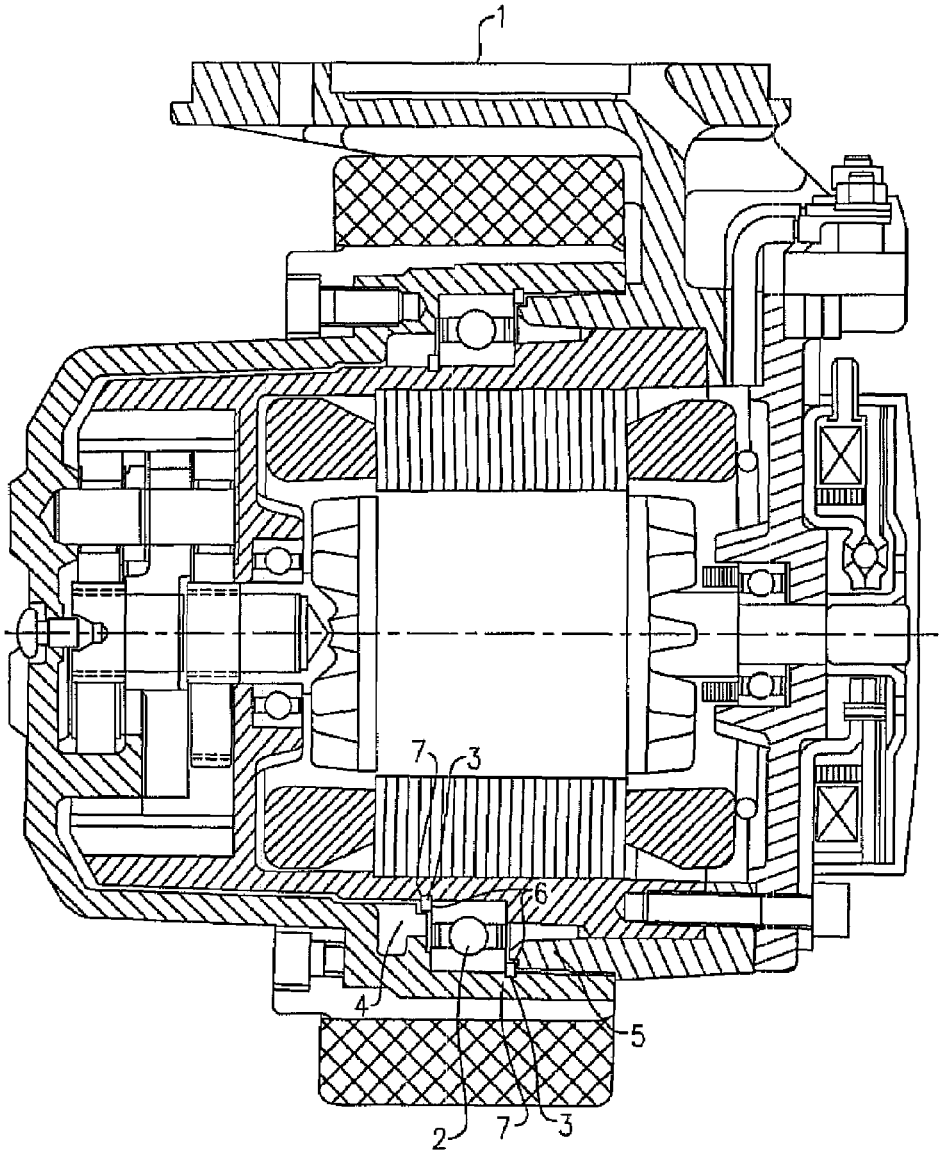
FIG. 1 is a typical wheel hub drive with relevant new components.

In the Figure, to facilitate understanding of the invention, a wheel hub drive of the type most familiar to those with knowledge of the field is shown so that, in what follows, only the components relevant to the invention need be described and explained.

According to the invention, a bearing 2 is positioned in line with a pole pivot point 1 and centrally with respect to the wheel area and the bearing 2 is secured axially by two spring clip-rings 3 seated in grooves 7. Moreover, according to the invention, parts of a housing 4, 5 that form a gap 6 over the clip-rings 3 are extended in the direction of the clip-rings 3 so that the gap 6 above the clip-rings 3 is smaller than the grooves 7 in which the clip-rings 3 are seated. This ensures that the running wheel is axially secured even under extreme conditions since, even if the spring force of the clip-rings 3 is overcome by the effect of external forces, the clip-rings 3 will still be held securely in their grooves 7, because of the structure of the gap 6 according to the invention.

REFERENCE NUMERALS

1 pole pivot point
2 bearing
3 clip-ring
4 housing part
5 housing part
6 gap
7 groove

The invention claimed is:

1. An axial securing system for a wheel bearing (2) of a pole-guided vehicle, in which the wheel bearing (2) is positioned in line with a pole pivot point (1) and centrally with respect to a running wheel area, the axial securing system comprising at least two spring clip-rings (3) seated in grooves (7), and parts of the housing (4, 5) that form a gap (6) over the clip-rings (3) are extended in a direction of the clip-rings (3) so that the gap (6) above the clip-rings (3) is smaller than the grooves (7) in which the clip-rings (3) are seated.

* * * * *